US008776680B2

(12) United States Patent
Zimmerman, II et al.

(10) Patent No.: US 8,776,680 B2
(45) Date of Patent: Jul. 15, 2014

(54) MODULAR APPARATUS AND METHOD FOR COMPACTING TRASH

(75) Inventors: Michael T. Zimmerman, II, Laguna Beach, CA (US); William Godecker, Irvine, CA (US); Steven Whisler, Irvine, CA (US); Ray Hough, Maulden (GB)

(73) Assignee: B/E Aerospace, Inc., Wellington, FL (US)

( * ) Notice: Subject to any disclaimer, the term of this patent is extended or adjusted under 35 U.S.C. 154(b) by 0 days.

(21) Appl. No.: 13/428,234

(22) Filed: Mar. 23, 2012

(65) Prior Publication Data

US 2012/0240796 A1 Sep. 27, 2012

Related U.S. Application Data

(60) Provisional application No. 61/467,667, filed on Mar. 25, 2011.

(51) Int. Cl.
*B30B 15/30* (2006.01)
*B30B 15/32* (2006.01)

(52) U.S. Cl.
USPC ..... 100/35; 100/215; 100/218; 100/902

(58) Field of Classification Search
USPC ..... 100/215, 218, 226, 229 A, 240, 245, 100/902, 35
See application file for complete search history.

(56) References Cited

U.S. PATENT DOCUMENTS 358,375 A * 2/1887 Billings ..... 100/99
2,508,877 A * 5/1950 Walker et al. ..... 414/501
3,274,922 A 9/1966 Hefner
3,563,168 A 2/1971 Doninger
3,608,476 A 9/1971 Price et al.
3,654,855 A 4/1972 Longo
3,731,616 A 5/1973 Ligh
3,734,006 A 5/1973 Hennells
3,754,501 A 8/1973 Horn
3,754,503 A 8/1973 Hennells
3,756,143 A 9/1973 Hennells (Continued)

FOREIGN PATENT DOCUMENTS

CA 1011159 A1 5/1977
DE 2348285 A1 8/1975

(Continued)

OTHER PUBLICATIONS

International Search Report and Written Opinion of the ISA/US issued in related application PCT/US2012/030322, Jun. 21, 2012, 11 pages.

*Primary Examiner* — Jimmy T Nguyen
*Assistant Examiner* — Leonel Vasquez
(74) *Attorney, Agent, or Firm* — Drinker Biddle & Reath LLP

(57) ABSTRACT

A trash compaction system includes a trash receptacle through which trash is input; a compaction chamber in which trash is compacted; and a compactor mechanism operatively coupled with the compaction chamber to compact trash in a direction generally perpendicular to a direction in which the compaction chamber receives the trash. The compaction chamber has a closeable receiving opening in communication with the trash receptacle to receive trash into the compaction chamber. The closeable receiving opening is closeable by a movable cover positioned between the trash receptacle and the compaction chamber. The compaction chamber also has a closeable ejection opening through which the compacted trash is ejected.

20 Claims, 12 Drawing Sheets

(56) References Cited

U.S. PATENT DOCUMENTS

| | | | | | |
|---|---|---|---|---|---|
| 3,785,281 | A | * | 1/1974 | Ligh | 100/116 |
| 3,882,771 | A | | 5/1975 | Frohbieter | |
| 3,908,538 | A | | 9/1975 | Boyd | |
| 4,008,658 | A | | 2/1977 | Stock et al. | |
| 4,022,123 | A | | 5/1977 | Bachmann | |
| 4,044,569 | A | | 8/1977 | Harza | |
| 4,548,132 | A | | 10/1985 | Moon | |
| 4,559,870 | A | | 12/1985 | Krummacher et al. | |
| 4,620,479 | A | | 11/1986 | Diamond et al. | |
| 4,700,623 | A | | 10/1987 | Durbin et al. | |
| 5,001,975 | A | * | 3/1991 | Finden | 100/38 |
| 5,144,889 | A | * | 9/1992 | Alig et al. | 100/74 |
| 5,218,900 | A | | 6/1993 | Elliott | |
| 5,259,304 | A | | 11/1993 | Roberts | |
| 5,263,412 | A | | 11/1993 | Chenard et al. | |
| 5,490,455 | A | | 2/1996 | Conti et al. | |
| 5,619,915 | A | | 4/1997 | Wagner et al. | |
| 5,768,988 | A | * | 6/1998 | Meloni | 100/229 A |
| 5,813,323 | A | | 9/1998 | Nowak | |
| 5,960,710 | A | | 10/1999 | Holtom | |
| 6,367,377 | B1 | | 4/2002 | Gawley et al. | |
| 6,701,832 | B1 | | 3/2004 | Hawkins | |
| 7,096,780 | B1 | | 8/2006 | Hawkins | |
| 7,191,701 | B2 | | 3/2007 | Fukuizumi et al. | |
| 7,377,214 | B2 | * | 5/2008 | Schomisch et al. | 100/35 |
| 7,481,160 | B1 | * | 1/2009 | Simon et al. | 100/50 |
| 8,122,823 | B2 | | 2/2012 | Cunningham et al. | |
| 2005/0040939 | A1 | | 2/2005 | Jobes et al. | |
| 2008/0246334 | A1 | | 10/2008 | Drescher | |
| 2011/0283900 | A1 | | 11/2011 | Fritz et al. | |
| 2012/0067230 | A1 | * | 3/2012 | Fritz et al. | 100/35 |
| 2012/0137902 | A1 | | 6/2012 | Cunningham et al. | |

FOREIGN PATENT DOCUMENTS

| | | | |
|---|---|---|---|
| GB | 2109299 | A | 6/1983 |
| JP | 1 168597 | A | 7/1989 |
| JP | 06-016205 | A | 1/1994 |
| JP | 2003-275046 | A | 9/2003 |

* cited by examiner

MODULAR APPARATUS AND METHOD FOR COMPACTING TRASH

RELATED APPLICATION

This application claims priority to U.S. Provisional Patent Application No. 61/467,667, entitled "Modular Apparatus and Method for Compacting Trash," and filed on Mar. 25, 2011, the entirety of which is hereby incorporated by reference.

BACKGROUND

Embodiments are directed to a modular apparatus and method for compacting trash.

In prior apparatuses for compacting trash, the trash is compacted within a bin that is also used for collection of the compacted trash. Typically, trash would be placed in the compaction bin, a compaction cycle would compact the trash in the compaction bin, and the steps of placing trash into the compaction bin and compacting the trash may be repeated any number of times until the compaction bin becomes full.

Removing the compacted trash from the compaction bin may be very difficult or cumbersome for several reasons. The compaction bin may not be located in a convenient location, so accessing the compaction bin to remove the compacted trash may be difficult. In addition, the compacted trash may be very dense and heavy, making lifting the compacted trash out of the compaction bin difficult. Furthermore, the compacted trash may be tightly packed into the compaction bin such that the compaction bin tends to hold the compacted trash in place by a combination of friction and pressure between the compacted trash and the side walls of the compaction bin. As a result, a user attempting to empty the compaction bin may find lifting the compacted trash out of the compaction bin difficult.

Additionally, because of the combination of the friction and pressure making removal of the compacted trash difficult, conventional trash liners may easily tear if used in the conventional trash compactor. Consequently, a heavy duty trash liner having a high tensile strength capable of withstanding extraordinary forces may be required. These heavy duty trash liners may be significantly more expensive than the conventional trash liners.

Another problem with prior apparatuses for compacting trash relates to how their cost and efficiency scale with capacity. If a larger capacity of the trash compactor is desired in order to reduce the frequency with which the trash compactor must be emptied, the compaction bin may need to be made larger. Consequently, associated mechanical equipment which compacts the trash in the compaction bin, for example the compaction actuator, must also be made larger. These enlargements increase the weight and cost of the trash compactor. Furthermore, these enlargements would result in a larger and heavier quantity of compacted trash that needs to be removed from the trash compactor. Thus, the problems related to pressure and frictional forces between the compacted trash and the sides of the compaction bin increase as the capacity of the trash compactor is increased.

SUMMARY

Embodiments overcome problems of prior trash compactors to efficiently compact trash and make removal of compacted trash simple and effortless.

One significant aspect of the improvements to trash compaction described herein is the compaction of trash in a compaction chamber into relatively small discs of compacted trash that are easily removable from the compaction chamber. In various embodiments, the apparatus for compacting trash compacts the trash for just a few cycles, for example two or three cycles, before the compacted trash is removed from the compaction chamber. The apparatus for compacting trash may periodically eject the compacted trash from the compaction chamber for storage in a separate collection bin. In this way, the apparatus for compacting trash may efficiently compact a large amount of trash without being manually emptied by an operator. And furthermore, since the compacted trash is loosely collected into a separate collection bin, the compacted trash may be easily removed from the collection bin and disposed of. The collection bin may be flexibly made to any suitable shape for storage of the compacted trash without regard to the physical process of trash compaction itself. For example, the collection bin may be made as wide, long, and/or deep as desired to increase the storage capacity of compacted trash and fit within a prescribed cabinet space without affecting a size of the compaction chamber or associated mechanical equipment. In an embodiment shown in the attached figures, the collection bin is sized to fit within a standard aircraft industry ARINC (Aeronautical Radio, Incorporated) GAIN (Galley Insert) size 3 compartment (see ARINC Specification 810-2 "Definition of Standard Interfaces for Galley Insert (GAIN) Equipment, Physical Interfaces," available from ARINC Inc., 2551 Riva Road, Annapolis, Md., 21401, http://www.arinc.com). In an embodiment, the apparatus may be used to compact trash normally accumulated during travel, for example, trash remaining in an airplane flight from in-flight meal, snack and beverage services.

Space within the GAIN size 3 compartment comprising the apparatus is efficiently utilized by facilitating vertical insertion of trash into a horizontally-aligned compaction chamber or bin, horizontally-oriented compaction of the trash within the compaction chamber by a horizontally-oriented compaction mechanism into a platter of compacted trash, and horizontal ejection the platter of compacted trash from the compaction chamber into a collection bin below.

While the exemplary embodiments described herein are presented in the context of a GAIN size 3 compartment disposed in an aircraft galley, these embodiments are exemplary only and are not to be considered limiting. For example, embodiments of the apparatus for compacting trash may be adapted to fit within other sizes of under-utilized areas in an aircraft or vehicle galley. Various embodiments may thus be used in any vehicle, including aircraft, spacecraft, ships, buses, trains, recreational vehicles, trucks, automobiles, and the like. Embodiments of the apparatus for compacting trash may also be used in homes, offices, hotels, factories, warehouses, garages, and other buildings where it may be desirable to efficiently compact trash. In general, the embodiments may be used in any location or application in which efficient trash compaction is desired.

According to an embodiment, a trash compaction system includes a trash receptacle through which trash is input; a compaction chamber in which trash is compacted, the compaction chamber having a closeable receiving opening in communication with the trash receptacle to receive trash into the compaction chamber, the compaction chamber also having closeable ejection opening through which the compacted trash is ejected; and a compactor mechanism operatively coupled with the compaction chamber to compact trash in a direction generally perpendicular to a direction in which the compaction chamber receives the trash.

The ejection opening may be on an opposite side of the compaction chamber than the compactor mechanism such that the compactor mechanism compacts the trash in a direction toward the ejection opening.

The receiving opening may be on an upper side of the compaction chamber below the trash receptacle.

The compaction chamber may be generally horizontally-oriented and the direction in which the compaction chamber receives trash may be generally vertically-oriented.

The compacted trash may be ejected in a shape of a platter having a width substantially greater than a height thereof.

The trash may be compacted into a disc having a width essentially equal to a width of the compaction chamber and a height substantially less than a width of the compaction chamber.

The trash compaction system may also include a compacted trash collection bin disposed below the compaction chamber that receives and stores the ejected compacted trash.

The trash compaction system may also include a user interface panel by which the trash compaction system may be locally controlled.

The trash compaction system may also include a communications network interface by which the trash compaction system may be remotely controlled.

According to another embodiment, a trash compaction system includes a trash receptacle through which trash is input; a generally horizontally-oriented compaction chamber having a closeable vertically-oriented opening disposed to receive trash from above the compaction chamber via the trash receptacle, the trash to be compacted within the compaction chamber, the compaction chamber also having a closeable ejection opening at one lateral side through which the compacted trash is ejected; and a generally horizontally-oriented compactor mechanism operatively coupled with the compaction chamber to compact trash in a generally-horizontally oriented direction toward the one lateral side within the compaction chamber.

According to another embodiment, a method for compacting trash includes receiving trash in a compaction chamber through a closeable receiving opening via a trash receptacle; closing the closeable receiving opening of the compaction chamber; compacting the trash in a direction generally perpendicular to a direction in which the compaction chamber receives the trash; opening a closeable ejection opening in the compaction chamber; and ejecting the compacted trash from the compaction chamber through the closeable ejection opening.

The compacted trash may be ejected from the compaction chamber at an end of the compaction chamber toward which the trash is compacted.

The trash may be received into the compaction chamber in a generally vertically-oriented direction and compacted in a generally horizontally-oriented direction.

The trash may be compacted into a shape of a platter having a width substantially greater than a height thereof.

The method may further include receiving and storing the compacted trash in a collection bin disposed below the compaction chamber.

BRIEF DESCRIPTION OF THE DRAWINGS

Various embodiments are illustrated in the drawings and following discussion.

DETAILED DESCRIPTION

Figure 1:
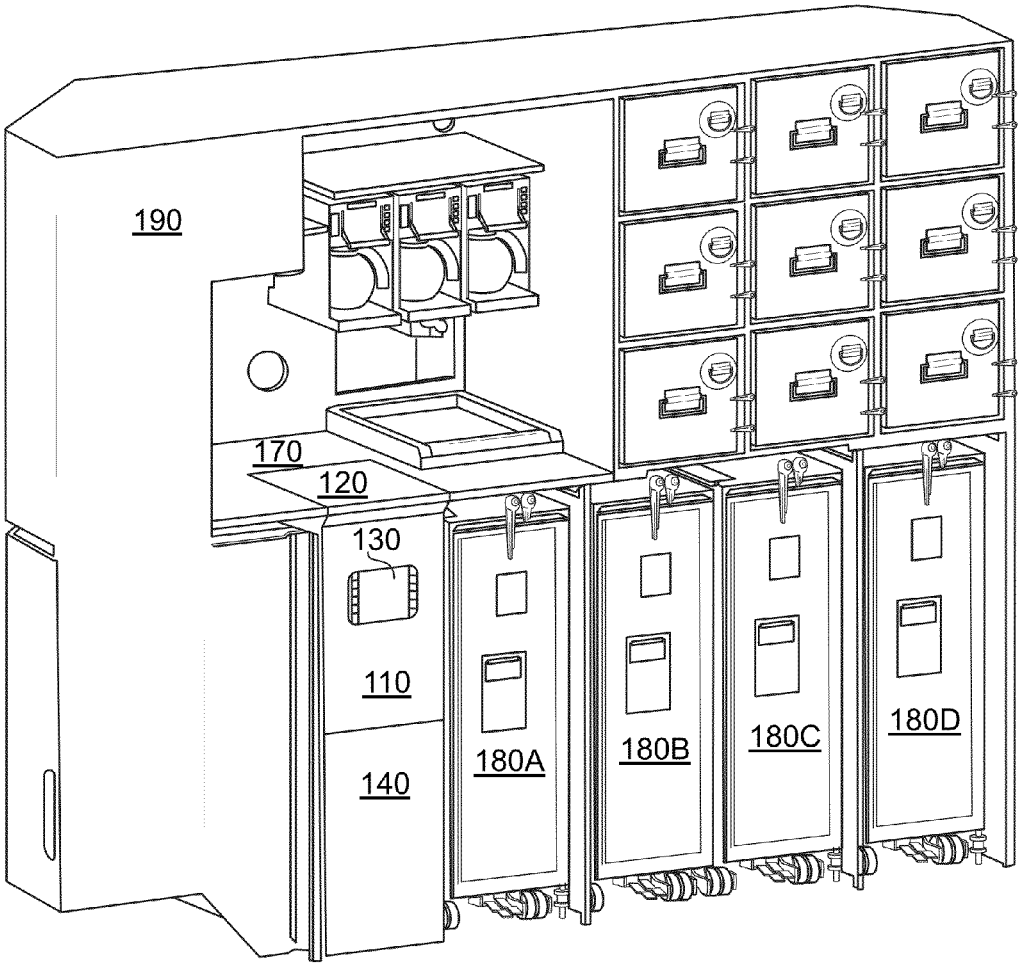
FIG. 1 illustrates a modular galley trash compactor in a GAIN size 3 cavity alongside various galley carts in a galley, according to an embodiment.

One significant aspect of the improvements to trash compaction described herein is the compaction of trash in a compaction chamber into relatively small discs of compacted trash that are easily removable from the compaction chamber. In various embodiments, the apparatus for compacting trash compacts the trash for just a few cycles, for example two or three cycles, before the compacted trash is removed from the compaction chamber. Because the compacted trash is significantly smaller than the interior of the compaction chamber, there is a lack of significant pressure or frictional forces that make removal of the compacted trash from the compaction chamber difficult. For example, the compacted trash may be in a disc or platter-like shape which has a small side surface area that contacts the interior sides of the compaction chamber. Due to this small surface area of contact, when the compacted trash is removed from the compaction chamber, the pressure and frictional forces between the compacted trash and the side walls of the compaction chamber are small.

Embodiments may further reduce the pressure and frictional forces due to the compacted trash contacting the interior walls of the compaction chamber by using a cylindrical compaction chamber. For instance, a cylindrical compaction chamber, which has a circular cross section, is advantageous over conventional compaction chambers which have rectangular cross sections because there are no corners in which compacted trash may become wedged or stuck. Additionally, a cylinder has a smaller side surface area per unit volume than other containers that have square, rectangular, triangular, or other polygonal cross sections, thereby reducing pressure and frictional forces between a side surface of the compacted trash which contacts the interior sidewalls of the compaction chamber. A circular disc of compacted trash having a given unit volume of compacted trash has less surface area contacting sidewalls of a cylindrical compaction chamber than a rectangular brick of compacted trash having the same unit volume and a same top or bottom surface area in a comparable compaction chamber having a rectangular cross section.

Embodiments may also further reduce the surface area of the compacted trash that contacts the interior of the compaction chamber by compacting the trash into a disc such that the majority of the compacted trash is toward the center of the disc. In addition to improving load balance, a center-weighted disc of compacted trash with a small side surface area is more easily removable from the compaction chamber. This is because a center-weighted disc of compacted trash has less side surface area than an evenly distributed disc having the same volume of compacted trash.

In order to conveniently continue trash compaction operations without requiring an operator to intervene and empty the compaction chamber when full, the apparatus for compacting trash may periodically eject the compacted trash from the compaction chamber for storage in a separate collection bin. For example, the compacted trash may be ejected automatically according to a measured weight of the compacted trash, a measured volume of the compacted trash, a counted quantity of compaction cycles performed, an elapsed time since a prior compacted trash ejection, a received local ejection command input by a user, and a received remote ejection command transmitted over a communications network.

The collection bin may be as large as desired for collection and storage of compacted trash without requiring that the compaction chamber and associated mechanical equipment (e.g., a compaction actuator) be made larger. In this way, the apparatus for compacting trash may efficiently compact a large amount of trash without being manually emptied by an operator. And furthermore, since the compacted trash is loosely collected into a separate collection bin, the compacted trash may be easily removed from the collection bin and disposed of. An inexpensive standard strength trash bin liner may be used in the collection bin for this purpose, rather than an expensive high tensile-strength heavy-duty compaction chamber liner of prior apparatuses for compacting trash.

FIG. 1 illustrates a modular galley trash compactor 110 in a GAIN size 3 cavity alongside various galley carts 180A, 180B, 180C, and 180D in a galley 190, according to an embodiment. While embodiments of the apparatus for compacting trash may be used in any environment and for any application in which efficient compaction of trash is desired, various embodiments are discussed below in the context of application in an aircraft galley as a modular galley trash compactor 110. The modular galley trash compactor 110 is designed as a highly-efficient trash compaction system that is designed to fit into an aircraft industry standard ARINC GAIN size 3 compartment, as depicted in FIG. 1. In other embodiments, the modular galley trash compactor 110 may be adapted to fit within other under-utilized areas of a vehicle or galley. By using such a system instead of a prior galley trash compactor, trash compaction efficiency can be improved and aircraft fleet cost savings can be realized. The galley trash compactor 110 is used to compact any and all aircraft trash normally accumulated during in-flight meal, snack and beverage services. The galley trash compactor 110 may be architected for simplicity in operation and use, thereby providing high reliability performance as another advantage.

The galley trash compactor 110 may be installed in an ARINC GAIN size 3 compartment below a level of a counter 170 in the galley 190. The galley trash compactor 110 may include a trash receptacle covered by a trash lid 120 which fits within an inset within the counter 170 at a top of the galley trash compactor 110. The trash lid 120 may be flush with the surface of the counter 170 when the trash lid 120 is closed, thereby facilitating efficient use of the space of the trash counter 170 for standard uses of the galley 190, including food service preparation. In some embodiments, when the trash lid 120 is opened, the trash lid 120 may tilt upward at one side thereof in order to expose an opening into a trash compaction chamber within the galley trash compactor 110 (shown in other figures herein). In other embodiments, the trash lid 120 may open by sliding out horizontally from its closed position within the inset of the counter 170. The trash lid 120 may include a solenoid-activated latch and a lid open sensor. The trash lid 120 may provide enlarged access to facilitate easy insertion of trash into the galley trash compactor 110, for example by single hand operation.

The galley trash compactor 110 also includes a user interface panel (UIP) 130 on an upper portion of a front surface thereof. The UIP 130 may display information regarding operational status of the galley trash compactor 110 and accept input from a user to control operation of the galley trash compactor 110 through a user interface input manipulation unit as described elsewhere herein.

Figure 2:
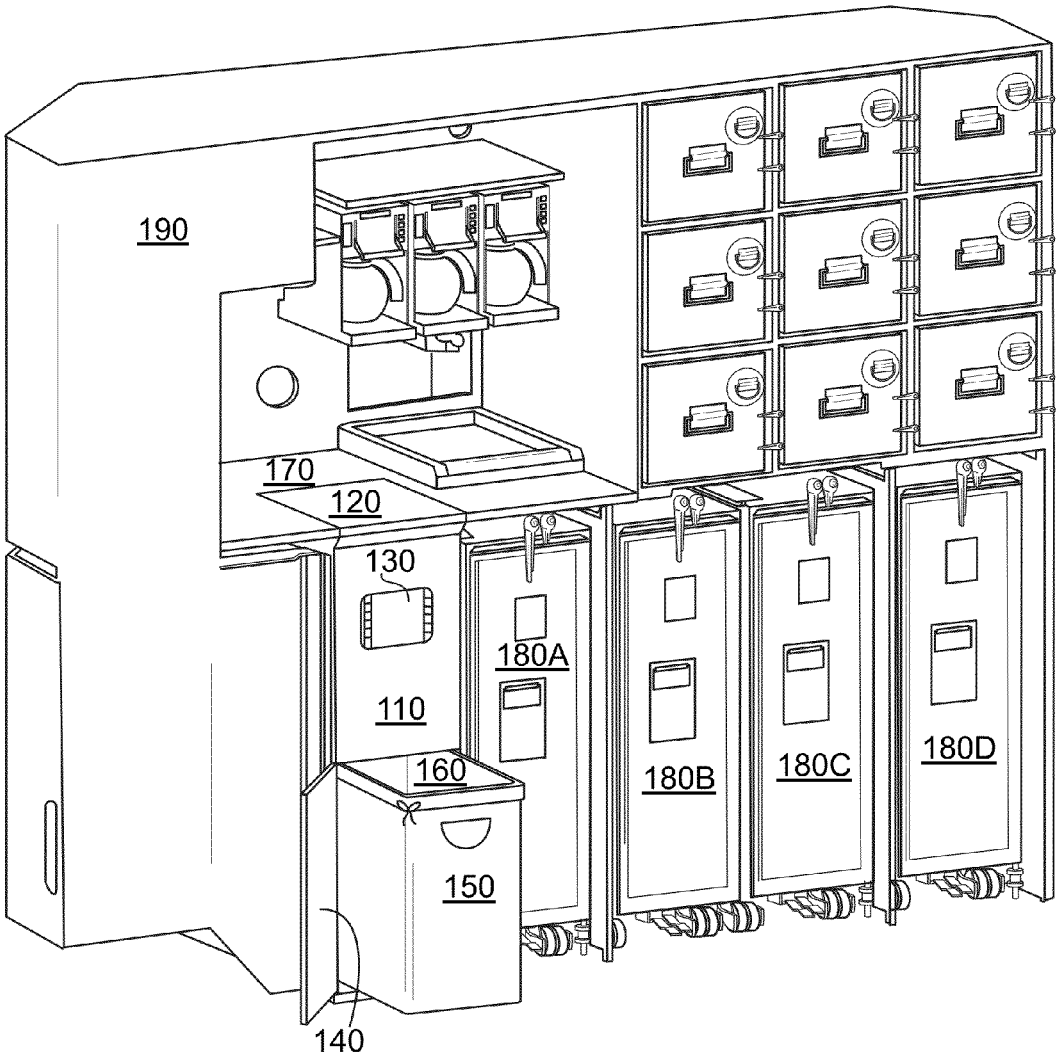
FIG. 2 illustrates the modular galley trash compactor of FIG. 1 with the empty compacted trash collection bin partially pushed in, according to an embodiment.
Figure 3:
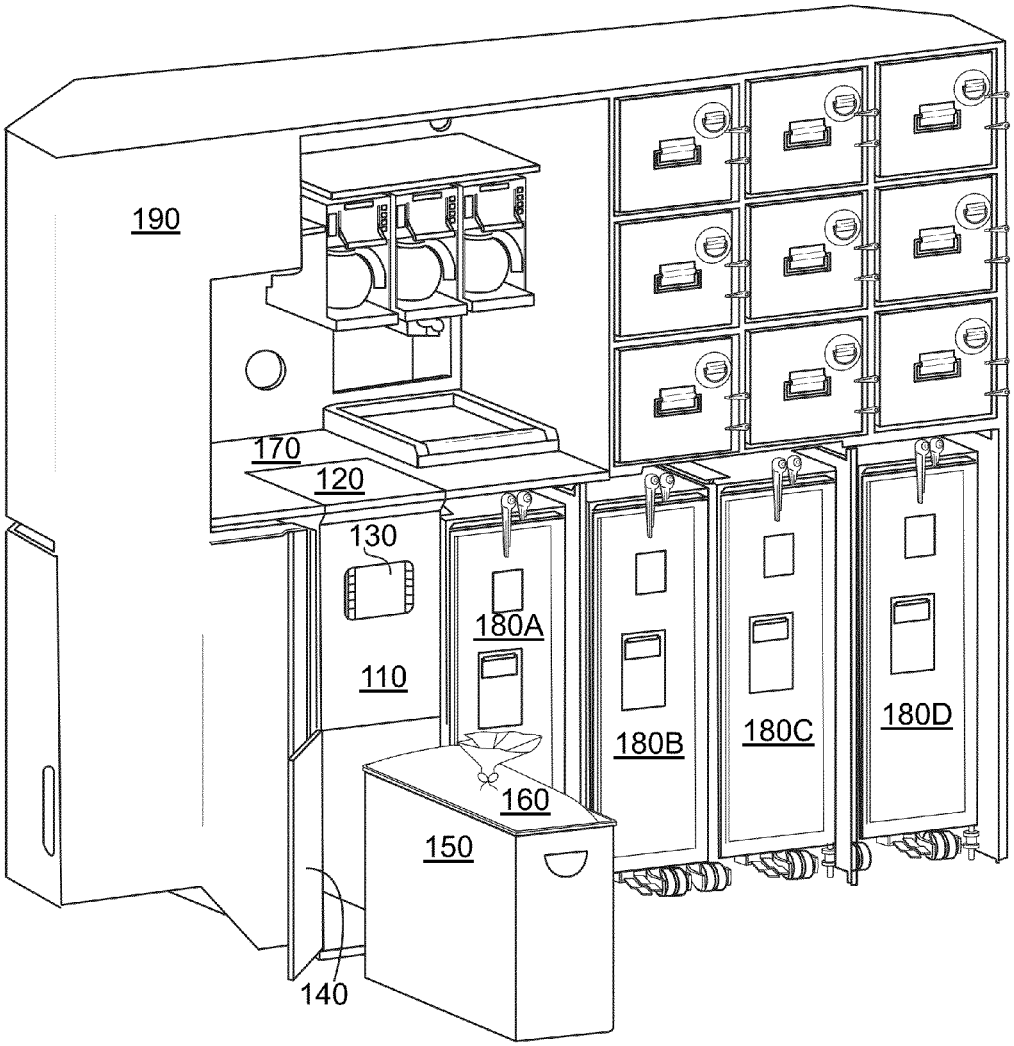
FIG. 3 illustrates the modular galley trash compactor of FIG. 1 with the full compacted trash collection bin completely pulled out and liner tied closed, according to an embodiment.

FIG. 2 illustrates the modular galley trash compactor 110 of FIG. 1 with an empty compacted trash collection bin 150 partially pushed in, according to an embodiment. FIG. 3 illustrates the modular galley trash compactor of FIG. 1 with the full compacted trash collection bin completely pulled out and liner 160 tied closed, according to an embodiment.

The galley trash compactor 110 may separate the mechanism for compacting trash from the bin for collection and storage of the compacted trash. For example, the mechanism for compacting the trash may be disposed in an upper portion of the galley trash compactor 110, while the bin for collection and storage of the compacted trash may be disposed in a lower portion of the galley trash compactor 110.

The lower portion of the galley trash compactor 110 may include an access door 140 on a lower portion of the front surface thereof. The access door 140 may be held in the closed position by latches. The access door 140 may swing open on hinges to provide access to the trash collection bin 150 therein. In an alternative embodiment, the access door 140 may be integrated with the trash collection bin 150 such that pulling the access door 140 straight out from the galley trash compactor 110 also pulls the trash collection bin 150 straight out.

The trash collection bin 150 may be lined with a liner 160. The liner 160 may hold the compacted trash and be closeable for convenient removal of the compacted trash from the trash collection bin 150. The liner 160 may include a string at a top end for tying the liner 160 closed when the liner 160 is full of compacted trash. Once the top end of the liner 160 is tied closed as illustrated in FIG. 3, the compacted trash may be conveniently removed from the trash collection bin 150. In the position illustrated in FIG. 3, the trash collected in the trash collection bin 150 may be easily extracted by a cabin crew member by simply lifting out the liner 160 as any standard trash bag. Because the trash is not actively compacted within the trash collection bin 150, but rather only collected in the trash collection bin 150 after being compacted in the compaction chamber, the compacted trash in the trash collection bin 150 may be as easily removable from the trash collection bin 150 as non-compacted trash in a conventional trash bin would be.

The UIP 130 may provide information as to the status of the galley trash compactor 110, for example how many compaction cycles have been performed since the compacted trash was last collected, how much compacted and/or uncompacted trash is stored within the trash collection bin 150 of the galley trash compactor 110, and the like. The UIP 130 may also provide controls by which a cabin crew member may open the trash lid 120, close the trash lid 120, activate a trash compaction cycle, eject compacted trash from the compaction chamber into the collection bin 150, or perform other functions, for example maintenance and tests. Operation of the galley trash compactor 110 via the UIP 130 may be simple and intuitive and harmonize with operation of other systems onboard the aircraft.

Figure 4:
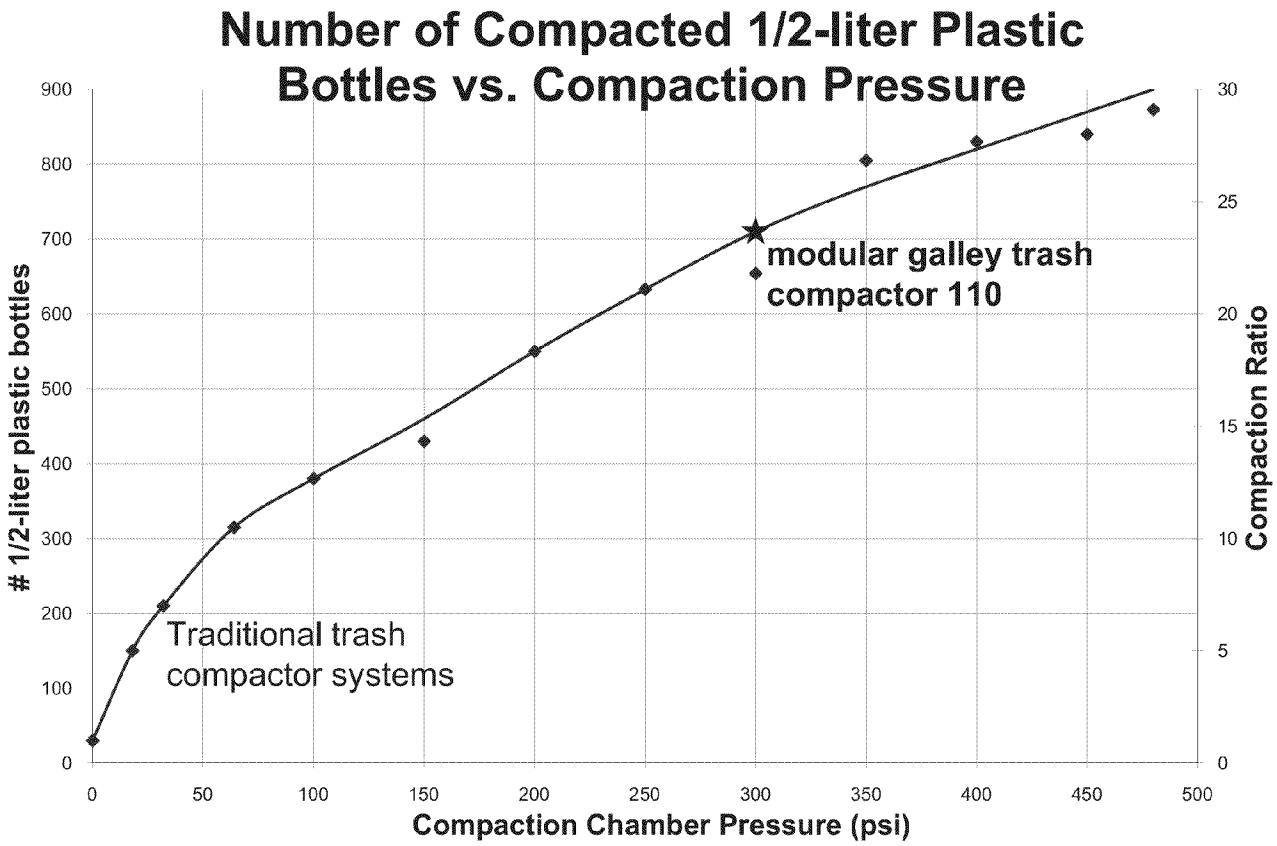
FIG. 4 is an exemplary graph of a number of half liter plastic bottles compacted vs. compaction pressure.

FIG. 4 is an exemplary graph of a number of half liter plastic bottles compacted vs. compaction pressure. As the graph of FIG. 4 illustrates, as the pressure of the compaction chamber (horizontal axis) increases, the number of half liter plastic bottles which may be compacted increases. The uncapped half liter plastic bottles exhibit a resilient "spring-back" property in which the bottles tend to spring back to a larger size than their fully compressed size when the compression pressure is too low. In order to efficiently compress half liter plastic bottles, the compression pressure should be greater than the limit below which the spring-back property is evident. This limit is referred to as "the plastic limit." As illustrated in the graph of FIG. 4, traditional trash compactor systems only achieve a compaction pressure in the range of less than fifty psi. In contrast, embodiments of the modular apparatus for compacting trash described herein, for example the galley trash compactor 110, exert a compaction pressure of approximately 300 psi to exceed the plastic limit, produce a high compaction ratio in excess of twenty times, and achieve compaction of a much larger number of half liter plastic bottles than prior trash compactor systems. In an embodiment, the compaction ratio of the galley trash compactor 110 may be approximately 22:1. Such a high compaction ratio may be efficiently achieved by using a cylindrical compaction chamber. The symmetry of a compact cylindrical compaction chamber facilitates high compaction pressures at low trash compaction mechanism weight.

As illustrated in Table 1 below, compaction of capped plastic half liter bottles are more difficult than uncapped plastic half liter bottles. The reason for this difficulty is the strength of the capped bottles. Table 1 indicates typical compression pressure for different types of trash compactor systems, and their respective number of capped plastic half liter bottle capacities.

TABLE 1

| Trash Compactor System Equipment | Compression (psi) | # Capped Plastic Bottles (Capacity) |
|---|---|---|
| Waste Trolley | 0 | 180 |
| IAC TC (4 boxes) | 20 | 180 |
| M3000 TC (4 boxes) | 32 | 200 |
| M4000 TC (6 bins) | 40 | 240 |
| Galley trash compactor 110 | 300 | 700 |

As illustrated in Table 2 below, the modular apparatus for compacting trash described herein (e.g., the galley trash compactor 110) weighs less, has a higher capacity, returns valuable cart space for other uses, and greatly reduces total cost of ownership compared with prior trash compactor systems.

TABLE 2

| Trash Compactor Configuration | Embodiments of the Galley Trash Compactor 110 | Prior Galley Cart Trash Compactors |
|---|---|---|
| Total Weight | 75 kg | 130 kg |
| Total Uncompressed Trash Capacity | 765 liters | 700 liters |
| Number of Available Aft Cart Bays | 1 Additional | Baseline |
| In-flight Servicing | Not Required | Necessary |
| Scheduled Maintenance Required | Not Required | Necessary |
| # Consumable Trash Compactor Containers Used Per Flight | 1 Bag | 4 Boxes |

Figure 5:
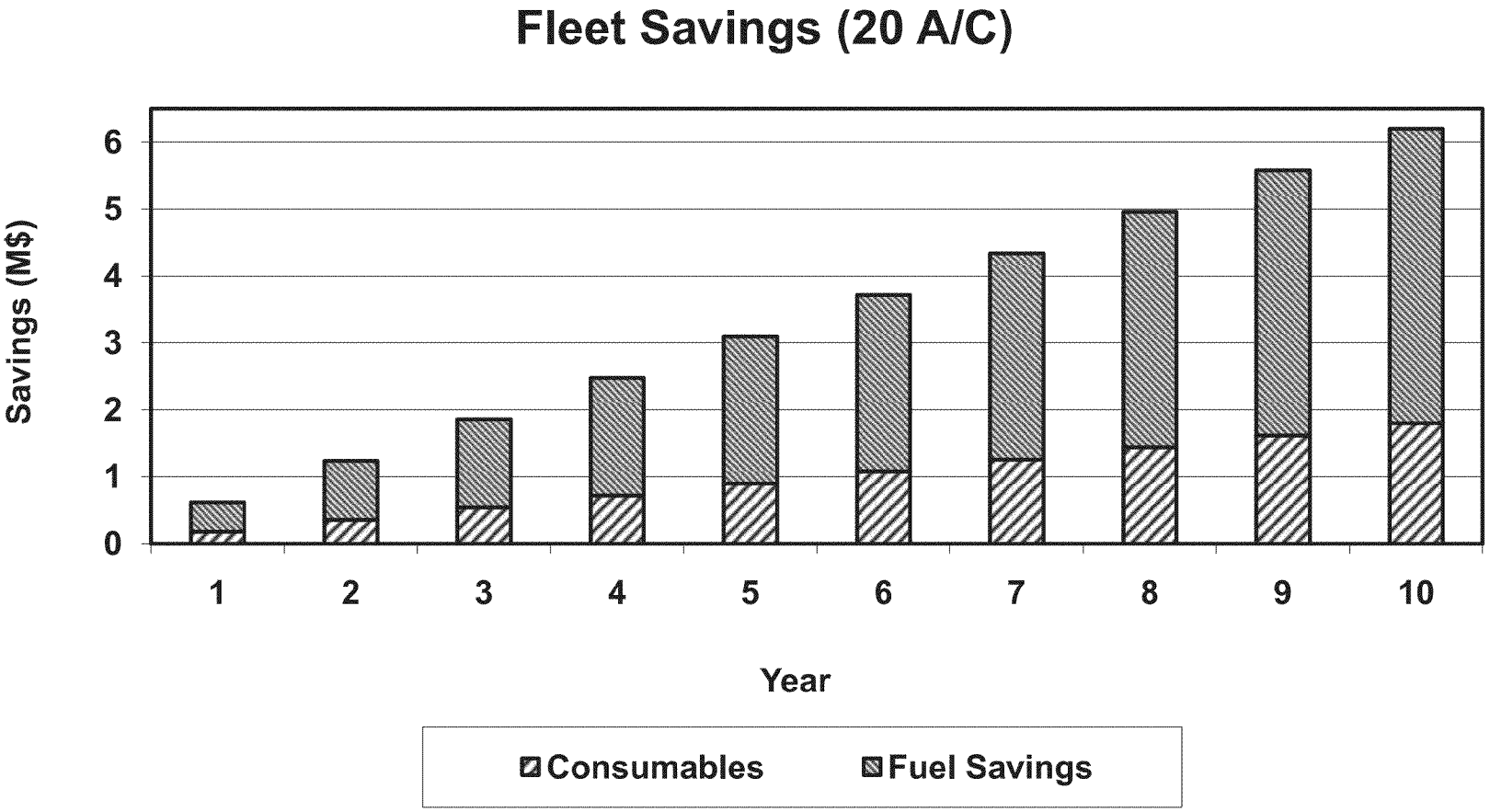
FIG. 5 is an exemplary graph of aircraft fleet savings resulting from use of an embodiment of the modular galley trash compactor in place of prior galley cart trash compactors.

FIG. 5 is an exemplary graph of aircraft fleet savings resulting from use of an embodiment of the modular galley trash compactor 110 in place of prior galley cart trash compactors. As illustrated in FIG. 5, a fleet of twenty aircraft may save in both consumables and fuel, with a bulk of the savings from fuel. The fleet savings range from over $500,000 in the first year to over $6,000,000 after ten years. The consumables savings range up to over $1,500,000 after ten years, while the fuel savings range up to approximately $4,500,000 after ten years.

There are a number of aspects of the modular galley trash compactor 110 which result in cost savings for a fleet of aircraft compared to prior trash compaction systems. One example is that the trash liner 160 need not have high tensile strength designed to sustain the high compaction pressures associated with trash compaction and the strong force of pulling the compacted trash out of the compaction bin caused by the compacted trash exerting strong pressure against the sides of the compaction bin. As a result, the liners 160 may be low cost. In addition, the low cost liners 160 replace the costly disposable boxes and metal bins used in prior galley cart trash compactors. In a typical long range flight, a single liner 160 may replace three to four disposable boxes of prior galley cart trash compactors. In an embodiment, a single liner 160 in a trash collection bin 150 may hold up to approximately 35 kg of compacted trash. In another embodiment, two liners 160 may be used in the trash collection bin 150, each of which holds up to approximately 15 kg of compacted trash. In this embodiment, the galley trash compactor 110 may include controls which limit the weight of the compacted trash within the liner 160 to 15 kg, 35 kg, or some other predetermined weight limit.

Because of the high efficiency associated with the galley trash compactor 110, fewer galley trash compactors 110 may be needed in an aircraft than prior galley cart trash compactors in order to service the same trash compaction requirements. As a result, in comparison with prior galley cart trash compactors, one storage trash cart compactor position may be eliminated facilitating monument consolidation in other galley locations onboard an aircraft. In addition, because of the weight savings from the compact, cylindrical compaction chamber and associated compactor mechanism, the galley trash compactor 110 may only weigh approximately 75 kg in comparison with approximately 120 kg for a prior galley cart trash compactor with a storage cart.

Figure 6:
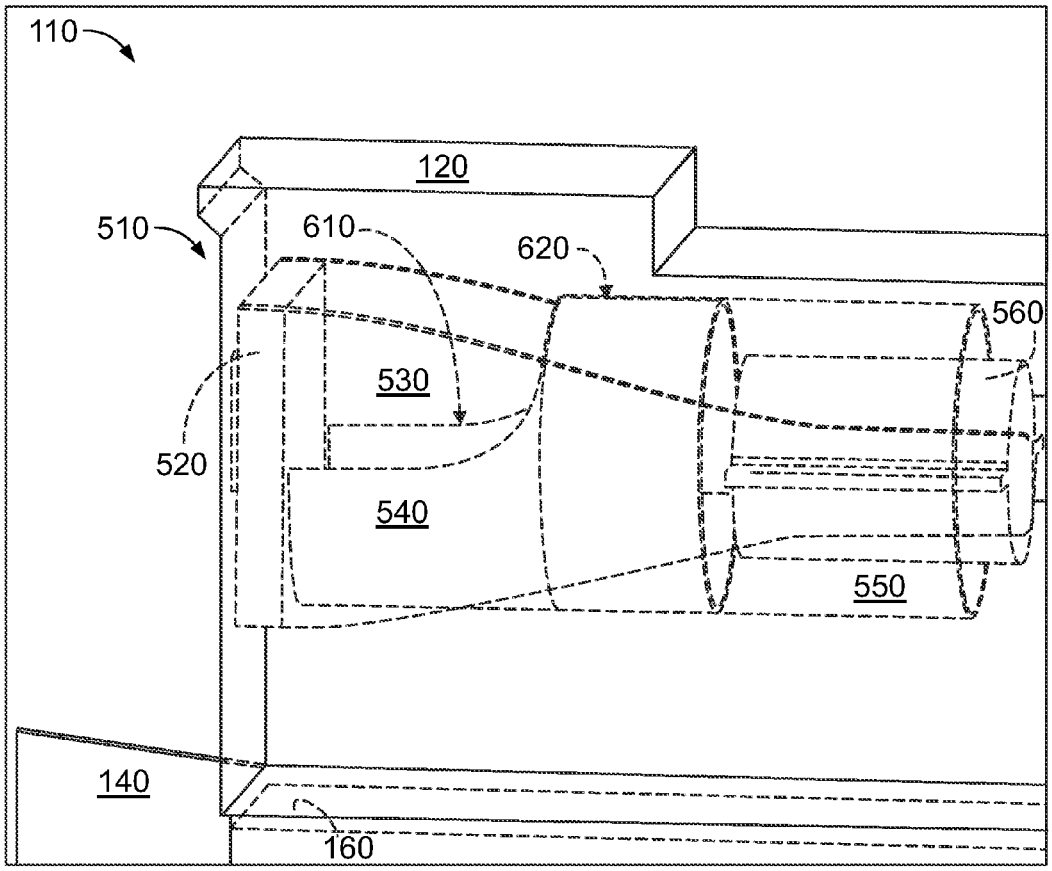
FIG. 6 illustrates components of the horizontally-aligned compactor mechanism of the modular galley trash compactor of FIG. 1 in an open compaction chamber state, according to an embodiment.

FIG. 6 illustrates components of the horizontally-aligned compactor mechanism 510 of the modular galley trash compactor 110 of FIG. 1 in an open compaction chamber state, according to an embodiment. The components of the galley trash compactor 110 illustrated in FIG. 6 are disposed below a level of the counter 170 of the galley 190. A generally horizontally-disposed compaction chamber 540 includes a slidably removable chamber cover 550. The compactor mechanism 510 may include a load sensor, a weight sensor, and a structural fail-safe sensor disposed in operational communication with the compaction chamber 540. A shape of the compaction chamber 540 may have an open side to the left adjacent a compaction plate 520, a top having a closeable receiving opening 610 which is open below the trash lid 120 when the chamber cover 550 is slid into an open position as illustrated in FIG. 6, and a fully encircled region 620 at a right side over which the chamber cover 550 slides. Below the compaction chamber 540 is a trash collection bin 150 lined with the liner 160. The collection bin 150 collects the compacted trash after being compacted in the compaction chamber 540 and ejected from the compaction chamber 540 as discussed below.

When the compactor mechanism 510 is in the open compaction chamber state as illustrated in FIG. 6, the compaction chamber 540 is extended against the compaction plate 520 while the chamber cover 550 is extended away from the compaction plate 520 in order to facilitate placement of trash into the compaction chamber 540 through an open trash lid 120 into an opening at the top portion of the compaction chamber 540. To the right of the compaction chamber 540 is a compactor actuator motor 560. The actuator motor 560 provides power used to compact the trash as illustrated in FIGS. 7-10. In some embodiments, the actuator motor 560 may include a hydraulic system Line Replaceable Unit (LRU).

The Hydraulic System LRU may include a compactor actuator, a pump assembly including a hydraulic pump, and a hydraulic fluid reservoir. The actuator compacts the trash inserted into the compaction chamber 540 using the ram 580. The hydraulic system LRU may include a hydraulic pump motor, motor driver electronics, hydraulic manifold, support assembly (collar), 4-way control valve, pressure transducer, pressure relief valve, fluid filter, ram sensor, and fluid level sensor.

The hydraulic system LRU may include a hydraulic pump motor that provides power to compact the trash using the actuator. The motor may drive the hydraulic pump within the pump assembly which pumps fluid from the hydraulic fluid reservoir to the actuator. The actuator may be, e.g., a three- or multi-stage telescopic actuator. System pressure may be monitored by the system controller through a pressure transducer. When the system pressure reaches a predefined amount (e.g., 3000 psi), power to the coil of the four-way hydraulic control valve may be removed and a spring-return action of the valve may return to "retract." The actuator may be retracted until it is fully retracted and the ram sensor may be activated, signaling the controller to stop the motor driver from operating the motor.

The hydraulic actuator may be made of, e.g., aircraft alloy steel. The three-stage cylinders and seals may be designed to meet a fatigue life of at least one million cycles as well as required burst pressures. This high-strength design enables the actuator to reach high compression force on a continual basis without sacrificing a gross weight penalty.

The motor used in the hydraulic system LRU is preferably a brushless DC motor designed to start smoothly under load and operate at any speed without sacrificing efficiency. The system controller preferably monitors power consumption and maximizes the motor speed at all times in order to meet predefined (e.g., 1000 W) power consumption requirements and minimize the compaction cycle duration as a convenience to the operator. The pump may also preferably be designed to provide high pressure at low motor speed where the load is highest.

The components of the compactor mechanism 510 may be held in place within the upper portion of the galley trash compactor 110 by a mechanism frame 530. In an embodiment, the compactor mechanism 510 may be behind the UIP 130 and above the liner 160 of the trash collection bin 150. Active electronics for controlling the compaction mechanism 510 may be disposed above a zone in which spills may occur. Such electronics may be located within a galley panel, for example. By locating the electronics away from a zone in which spills may occur, a frequent cause of trash compaction system failures may be eliminated.

The compaction chamber design is preferably cylindrical, which allows for much higher compacting pressures than that of a conventional rectangular box design. In fact, the compaction pressure for most in-flight trash can be ten times higher in the galley trash compactor 110 than that of conventional trash compactors. This results in four times more compaction efficiency, when measured against the volume of uncompressed-to-compressed material ratios. The cylindrical chamber design is achieved by a cylindrical compaction chamber 540 and a cylindrical chamber cover 550.

The cylindrical compaction mechanism 510 may utilize stainless steel components, including the compaction plate 520, the compaction chamber 540, and the chamber cover 550, in order to prevent jamming. The cylindrical shape of the compaction chamber 540 coupled with the fact that the compaction chamber 540 is separate from the compacted trash storage also contributes to the elimination of jamming.

During operation, a cabin crew member may insert trash through the opening of the trash receptacle under the trash lid 120. During this process, the compaction chamber 540 is in an open state as illustrated in FIG. 6. The trash may then be deposited in the compaction chamber 540 and rest on a solid bottom portion of the compaction chamber 540. After the trash is completely inserted into the compaction chamber 540, the cabin crew member may press a button on the UIP 130 and/or manually close the trash lid 120.

After there is an appreciable amount of trash in the compaction chamber 540, a COMPACT button on the UIP 130 may be pressed to start a compaction process while the trash lid 120 is closed. In some embodiments, the galley trash compactor 110 may automatically detect that the compaction chamber 540 is full enough to start a compaction cycle, and the compaction cycle may be automatically initiated in response to compact the trash in the compaction chamber 540, once the trash lid 120 is closed. The galley trash compactor 110 unit may not perform a compaction cycle while the trash lid 120 is open for safety purposes, and may include a safety interlock to prevent compaction from occurring when the trash lid 120 is opened. The trash compaction process may be repeated for several cycles, after which the compacted trash may be emptied from the compaction chamber 540 into the collection bin 150 below. The compacted trash may be deposited into the collection bin 150 before the compaction chamber 540 is full.

Figure 7:
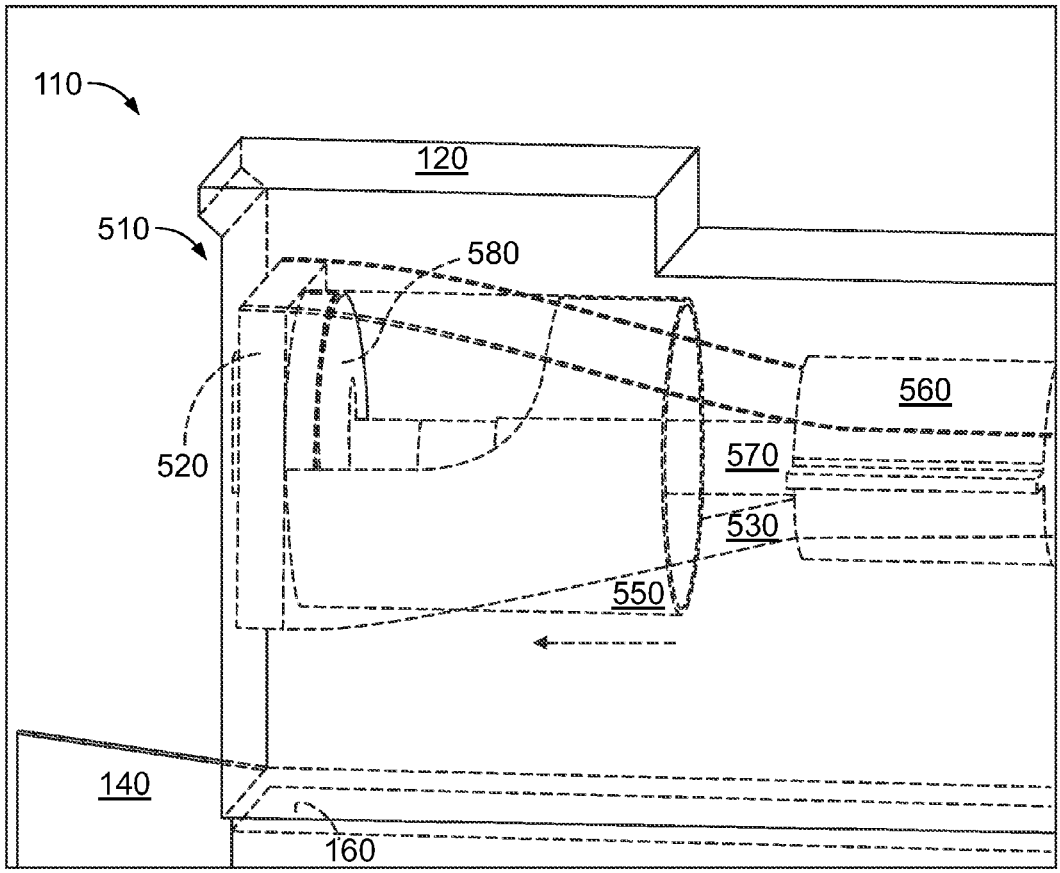
FIG. 7 illustrates components of the horizontally-aligned compactor mechanism of the modular galley trash compactor of FIG. 1 in a trash compacted state, according to an embodiment.
Figure 8:
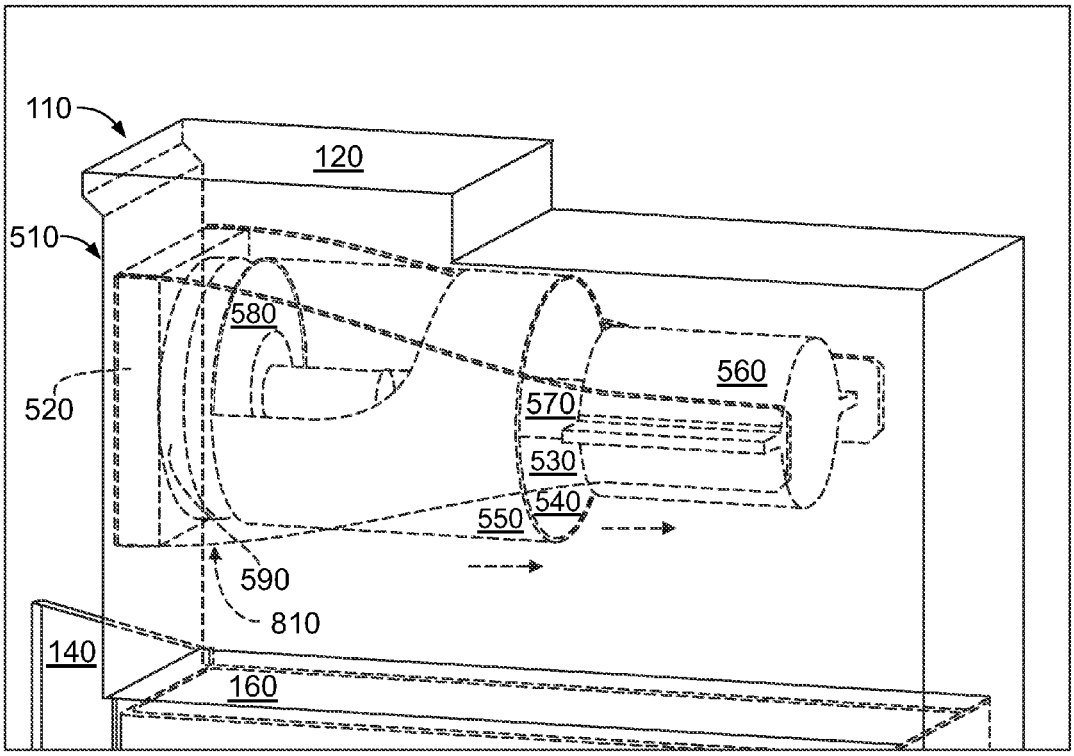
FIG. 8 illustrates components of the horizontally-aligned compactor mechanism of the modular galley trash compactor of FIG. 1 beginning a compacted trash ejection cycle, according to an embodiment.
Figure 9:
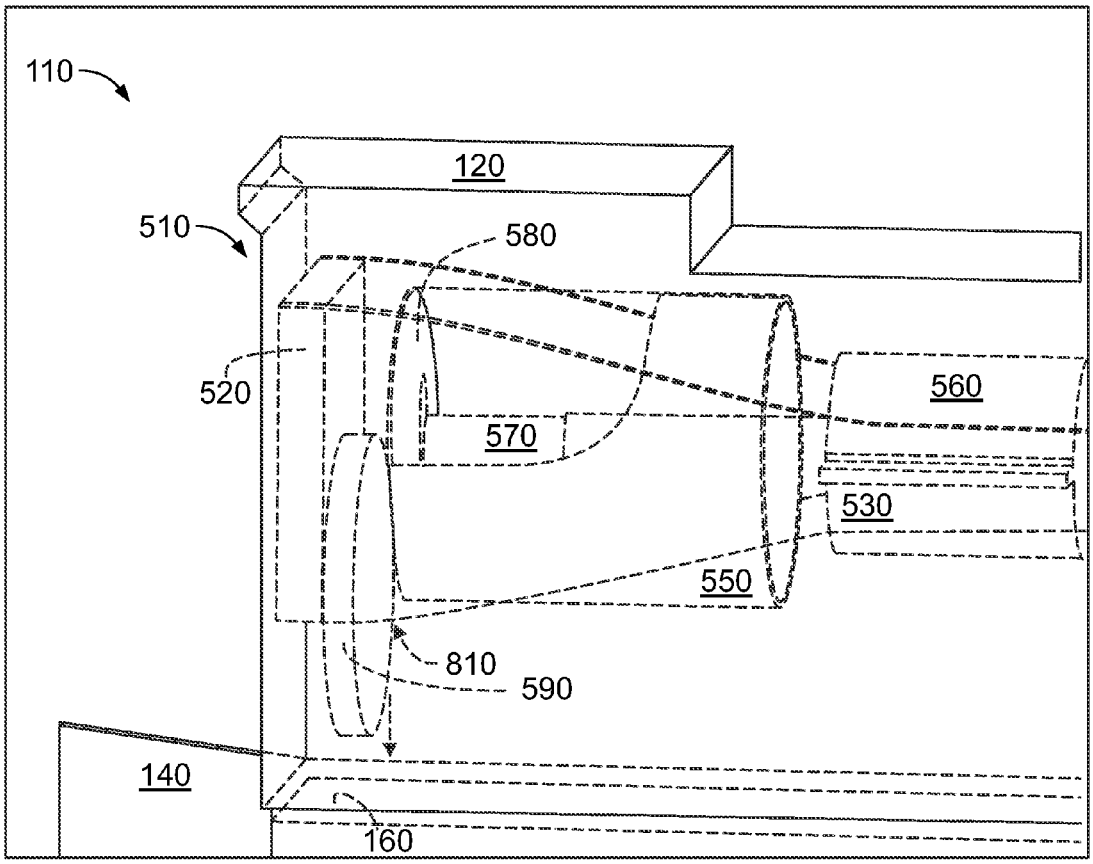
FIG. 9 illustrates components of the horizontally-aligned compactor mechanism of the modular galley trash compactor of FIG. 1 continuing a compacted trash ejection cycle, according to an embodiment.

FIG. 7 illustrates components of the horizontally-aligned compactor mechanism 510 of the modular galley trash compactor 110 of FIG. 1 in a trash compacted state, according to an embodiment. FIG. 8 illustrates components of the horizontally-aligned compactor mechanism of the modular galley trash compactor of FIG. 1 beginning a compacted trash ejection cycle, according to an embodiment. FIG. 9 illustrates components of the horizontally-aligned compactor mechanism of the modular galley trash compactor of FIG. 1 continuing a compacted trash ejection cycle, according to an embodiment.

When the compaction cycle begins, the compaction chamber cover 550 slides into a closed position against the compaction plate 520 to enclose the compaction chamber 540. The compactor actuator motor 560 pushes the compactor ram 580 using the compactor rod 570 from a position at a right end of the compaction chamber 540 to a position at the left end of the compaction chamber 540 against the compaction plate 520. In doing so, the compactor actuator motor 560 compresses the trash in the compaction chamber 540 by a large compaction ratio of approximately 22:1.

The ram 580 may have a curved surface that presses onto the trash such that the trash is directed more toward the center of the compaction chamber 540 than the sides of the compaction chamber 540. In other words, the compaction surface of the ram 580 may be sloped inward (concavely) from the outer edges to the center. By directing trash more toward the center of the compaction chamber 540 than the sides of the compaction chamber 540, load balance may be improved, the compacted trash may be less likely to jam during operation of the galley trash compactor 110, and the compacted trash may be more easily ejected from the compaction chamber 540 after a compaction cycle. After the ram 580 has compacted the trash, the compacted trash 590 may be formed into a disc shape as illustrated in FIG. 8. In various embodiments, the compacted trash 590 may be thicker at the center than at the edges, be formed in a meniscus shape, or have other non-uniformities in its shape. In general, the compacted trash 590 may have a significantly larger width than height, and in that sense be formed in a shape of a cookie, a platter, a disc, or the like.

After one or more compaction cycles are complete, the compacted trash may be ejected from the compaction chamber 540. The ejection may be activated by a cabin crew member via the UIP 130, via remote control, for example from the cockpit via a communications network, or automatically based on how full the compaction chamber 540 has become or based on a number of compaction cycles performed since the prior ejection of compacted trash was performed. To eject the compacted trash, the compaction chamber 540 and the compaction chamber cover 550 are moved to the right from the compaction plate 520, while the ram 580 moves to the far left position within the compaction chamber 540. As a result, the compacted trash 590 is horizontally ejected from the compaction chamber 540 by the ram 580 and is in a position to fall by the force of gravity into the liner 160 of the trash collection bin 150 below, as illustrated in FIG. 9. The galley trash compactor 110 may perform multiple compaction cycles by which compacted trash is ejected from the compaction chamber 540 into the trash collection bin 150 before the trash collection bin 150 becomes full.

After the compacted trash is ejected from the compaction chamber 310 into the collection bin 320, the trash compaction mechanism 510 may return to the open position as illustrated in FIG. 6 so that more trash may be inserted into the compaction chamber 540.

In various other embodiments, the compaction chamber 540 may be opened in other ways and using other mechanisms to eject the compacted trash into the collection bin 150. For example, the compaction plate 520 may slide or be rotated away from the compaction chamber 540, or the compaction plate 520 may comprise two halves each of which are each swung, rotated, or slid away from the left side of the compaction chamber 540 in order to open the left side thereof to eject the compacted trash by the ram 580 pressing the compacted trash 590 to the left and out of the compaction chamber 540.

Although not shown, components of the compaction mechanism 510 may include an E-box LRU. The E-Box LRU includes an electronic system controller for the galley trash compactor 110. The E-Box LRU may interface with the UIP 130 to control the compactor actuator motor 560. The electronic system controller of the E-box LRU may include a microprocessor-driven control system, fuse protection, electro-magnetic interference (EMI) protection, a power converter transformer, and an external sensor array.

The modular apparatus for compacting trash may be powered by 3-phase variable-frequency aircraft power or may be adapted to other input power sources. The galley trash compactor 110 may be independent of all other galley components and may easily be integrated into the structure of the galley work deck.

Operation of the galley trash compactor 110 may be via a locally mounted user interface panel (UIP) 130, providing push button operation, lamp indications and text messages, as well as any other user input and output. The galley trash compactor 110 may also be operated via remote control. The galley trash compactor 110 preferably integrates with the aircraft's galley system via a Controller Area Network (CAN) bus interface (the galley data bus) to the galley network controller (GNC). The GNC preferably handles all network communications and arbitrates cooperative power control in the galley group.

Figure 10:
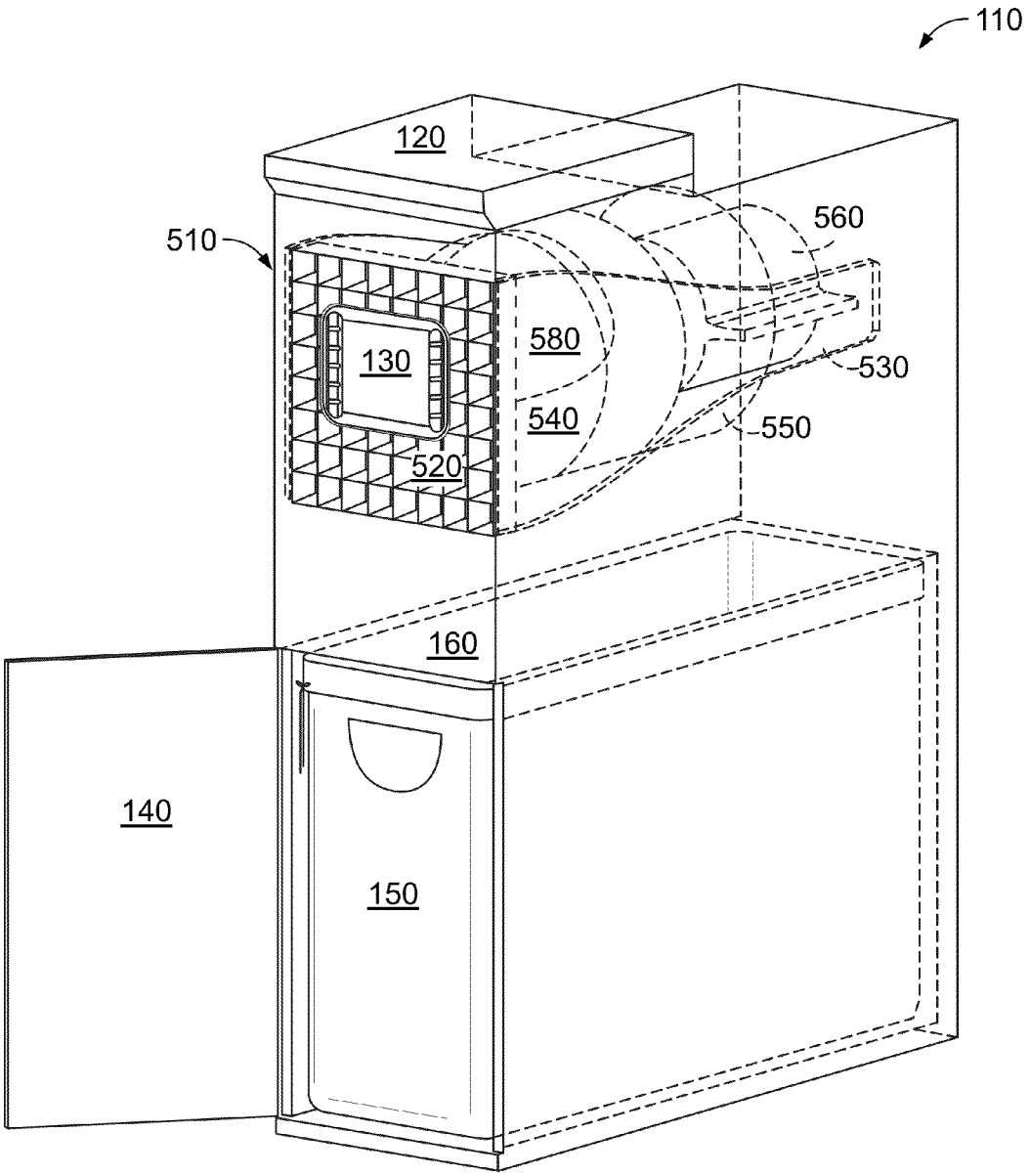
FIG. 10 illustrates components of the modular galley trash compactor of FIG. 1 in more detail, according to an embodiment.
Figure 11:
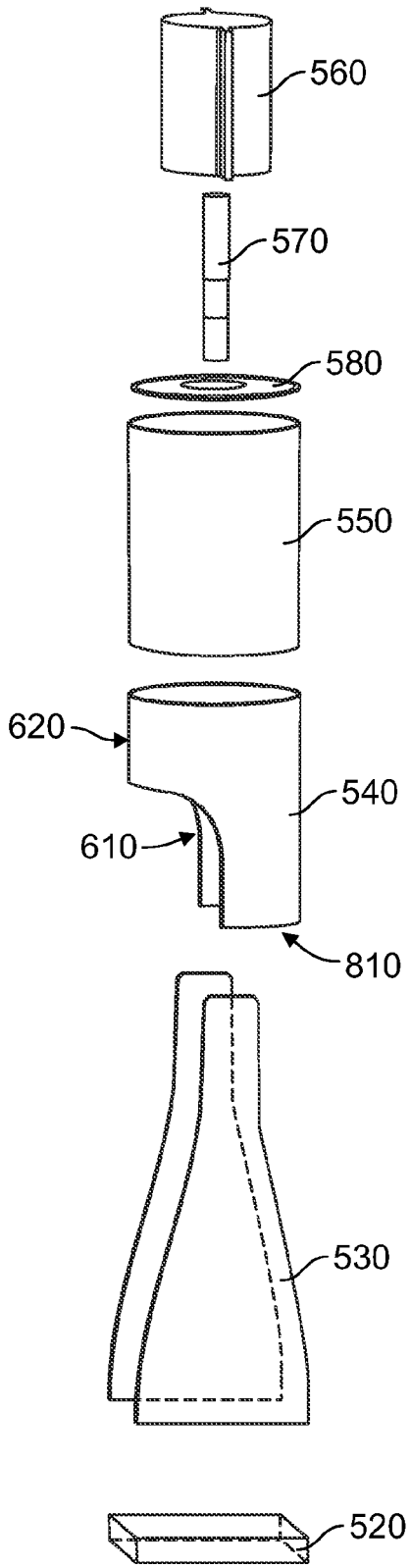
FIG. 11 illustrates components of the horizontally-aligned compactor mechanism of the modular galley trash compactor of FIG. 1 in an exploded view, according to an embodiment.

FIG. 10 illustrates components of the modular galley trash compactor 110 of FIG. 1 in more detail, according to an embodiment. FIG. 11 illustrates components of the horizontally-aligned compactor mechanism 510 of the modular galley trash compactor 110 of FIG. 1 in an exploded view, according to an embodiment. The elements illustrated in FIGS. 10 and 11 have been previously discussed with reference to FIGS. 1-3 and 6-9.

There are a number of advantages of the galley trash compactor 110 compared to prior galley cart compaction systems, some of which are itemized below.

- Trash may be loaded into the trash receptacle through an opening below the trash lid 120 easily, either individually or entire trash collection bags.
- The top-loading design of the galley trash compactor 110 also isolates waste compaction from compacted trash storage, thereby providing for more hygienic operations.
- The UIP 130 provides simple one touch operation.
- The galley trash compactor 110 provides convenient access and operation to minimize human performance factors.
- Because of the high compaction efficiency, the galley trash compactor 110 provides high compacted trash storage capacity which is adequate for multi-segment flight routes as well as long-haul flights, e.g. 18 hour flights. As such, in-flight servicing and bag changes may be eliminated, freeing flight crew for other duties.
- By facilitating gravity feed of the compacted trash 590 into the liner 160, damage to the liner 160 that may be caused by high compaction pressures in prior galley cart trash compaction systems is prevented.
- Maintenance of the galley trash compactor 110 including cleaning of the ram 580 and compaction chamber 540 may be performed from a standing position. Therefore, maintenance may be quick and convenient, reducing maintenance and total operational costs of the galley trash compactor 110 compared to prior galley cart trash compaction systems.
- Repair of the galley trash compactor 110 may be performed using a line replaceable unit (LRU) repair approach, which is simple, fast, and efficient.

In various embodiments, the galley trash compactor 110 may meet the following specifications:

Performance:
- Compaction pressure: 316 psi
- Volume compression: 22:1

Figure 12:
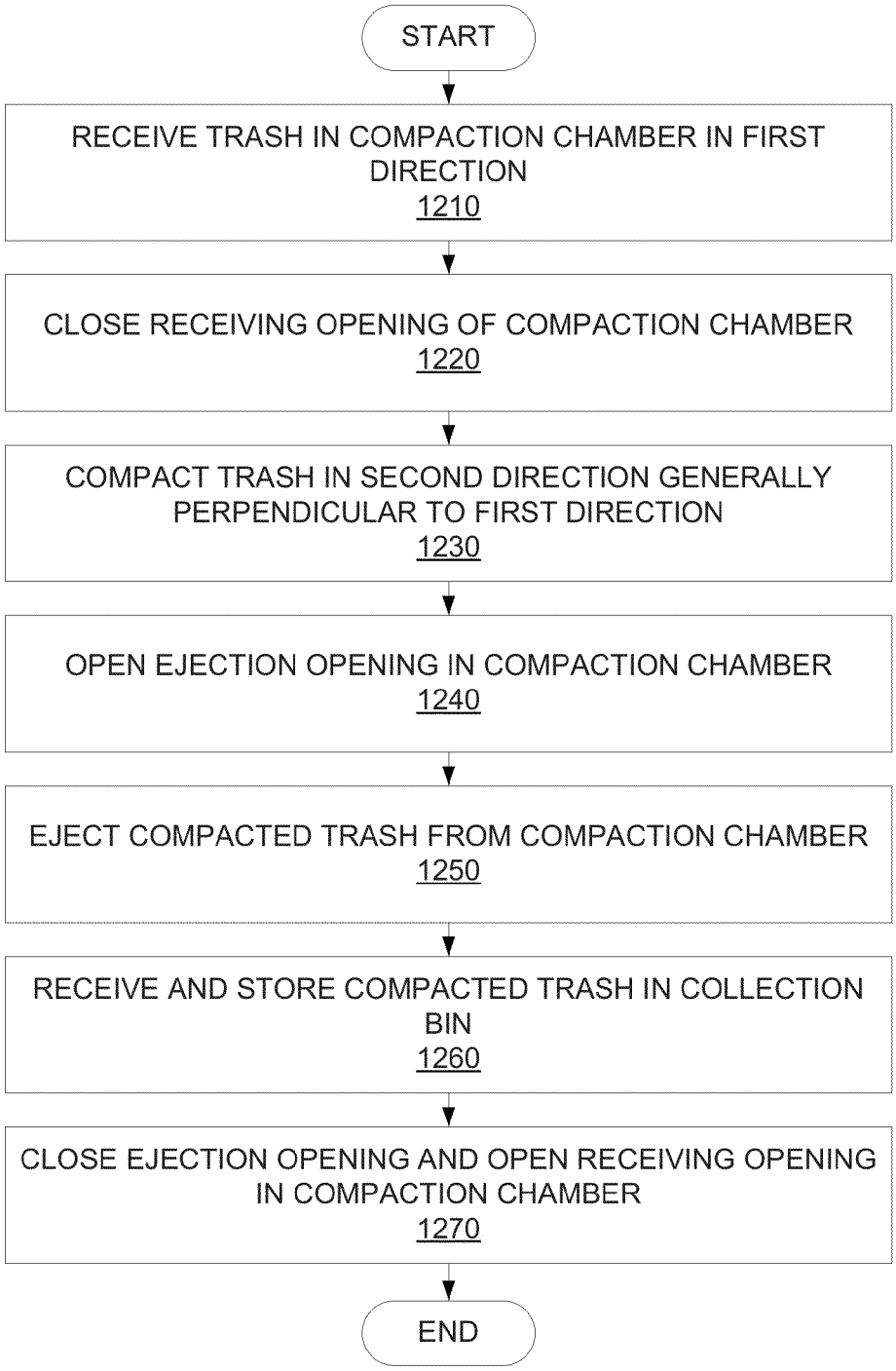
FIG. 12 illustrates a method of compacting trash, according to an embodiment.

Aircraft interface:
- Custom fit LRU dimensions: ARINC GAIN size 3
- Electrical: 115/220V, 3-phase, 360-800 Hz, 1.0 KVA (max)
- Weight: 75 kg, including composite collection bin Consumable Trash Container
- Heavy-duty polyethylene bag
- Form-fitted to collection bin
- Withstands ruptures
- Disposable
- Easy to install and remove
- Recyclable FIG. 12 illustrates a method of compacting trash, according to an embodiment.

In a step 1210, trash is received in a compaction chamber, i.e., the compaction chamber 540, in a first direction. The first direction may be a vertical direction. For example, a user may open the trash lid 120, and while the chamber cover 550 is slid into an open position as illustrated in FIG. 6, the user may place trash into the compaction chamber 540.

In a step 1220, the receiving opening of the compaction chamber may be closed. For example, after the user places trash in the compaction chamber 540, the user may close the trash lid 120, and the chamber cover 550 may slide into a closed position as illustrated in FIG. 7.

In a step 1230, the compaction chamber may compact trash in a second direction which is generally perpendicular to the first direction in which trash is received into the compaction chamber. For example, the trash may be compacted in compaction chamber 540 in a generally horizontal direction by the compactor actuator motor 560 pushing the compactor ram 580 using the compactor rod 570 from a position at a right end of the compaction chamber 540 to a position at the left end of the compaction chamber 540 against the compaction plate 520.

In a step 1240, an ejection opening 810 in the compaction chamber is opened. For example, the chamber cover 550 may be slid into a partially open position while the compaction chamber 540 moves in concert with the chamber cover 550 away from the compaction plate 520 as illustrated in FIG. 8. By doing so, an opening is created between the compaction chamber 540 and the compaction plate 520 in which the compacted trash 590 is exposed.

In a step 1250, the compacted trash is ejected from the compaction chamber. For example, after the compaction chamber 540 and chamber cover 550 are moved away from the compaction plate 520 as illustrated in FIG. 8, the ram 580 may be moved away from the compaction plate 520 along with the compaction chamber 540 and chamber cover 550, as illustrated in FIG. 9. By doing so, the compacted trash 590 is released and ejected by the force of gravity from its position between the ram 580 and the compaction plate 520.

In a step 1260, the compacted trash is received and stored in a collection bin. For example, the compacted trash 590 may fall into the liner 160 within the trash collection bin 150 as illustrated in FIG. 9.

In a step 1270, the ejection opening 810 in the compaction chamber is closed while the receiving opening is opened. For example, the chamber cover 550 may be slid into a fully open position while the compaction chamber 540 moves in opposition to the chamber cover 550 toward and against the compaction plate 520 as illustrated in FIG. 6. The galley trash compactor 110 may then be ready to receive more trash to be compacted, and the method of FIG. 12 may be repeated until the compacted trash needs to be emptied from the trash collection bin.

A method for emptying compacted trash from the galley trash compactor 110 may include the following exemplary steps. After the trash has been compacted and deposited into the liner 160 within the trash collection bin 150, the UIP 130 may display an indication that the trash collection bin 150 of the galley trash compactor 110 is full and should be emptied. A user may then open the door 140 either manually, or by manipulating a user interface of the UIP 130, for example pressing a button. Once the door 140 is opened, the trash collection bin 150 may be pulled out of the lower portion of the galley trash compactor 110. Thereafter, the top end of the liner 160 may be tied closed, and the closed liner 160 containing the compacted trash may be pulled out of the trash collection bin 150 and disposed of. A new liner 160 may then be inserted into the trash collection bin 150, and the trash collection bin 150 may be slid back into the lower portion of the galley trash compactor 110. Finally, the door 140 may be closed.

All references, including publications, patent applications, and patents, cited herein are hereby incorporated by reference to the same extent as if each reference were individually and specifically indicated to be incorporated by reference and were set forth in its entirety herein.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The terminology used herein is for the purpose of describing the particular embodiments and is not intended to be limiting of exemplary embodiments of the invention.

The apparatus for compacting trash described herein may comprise a processor, a memory for storing program data to be executed by the processor, a permanent storage such as a disk drive, a communications port for handling communications with external devices, and user interface devices, including a display, keys, etc. When software modules are involved, these software modules may be stored as program instructions or computer readable code executable by the processor on a non-transitory computer-readable media such as read-only memory (ROM), random-access memory (RAM), CD-ROMs, DVDs, magnetic tapes, hard disks, floppy disks, and optical data storage devices. The computer readable recording media may also be distributed over network coupled computer systems so that the computer readable code is stored and executed in a distributed fashion. This media may be read by the computer, stored in the memory, and executed by the processor.

Also, using the disclosure herein, programmers of ordinary skill in the art to which the invention pertains may easily implement functional programs, codes, and code segments for making and using the invention.

The invention may be described in terms of functional block components and various processing steps. Such functional blocks may be realized by any number of hardware and/or software components configured to perform the specified functions. For example, the invention may employ various integrated circuit components, e.g., memory elements, processing elements, logic elements, look-up tables, and the like, which may carry out a variety of functions under the control of one or more microprocessors or other control devices. Similarly, where the elements of the invention are implemented using software programming or software elements, the invention may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the invention may employ any number of conventional techniques for electronics configuration, signal processing and/or control, data processing and the like. Finally, the steps of all methods described herein may be performed in any suitable order unless otherwise indicated herein or otherwise clearly contradicted by context.

For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. The words "mechanism" and "element" are used broadly and are not limited to mechanical or physical embodiments, but may include software routines in conjunction with processors, etc.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the spirit and scope of the invention as defined by the following claims. Therefore, the scope of the invention is defined not by the detailed description of the invention but by the following claims, and all differences within the scope will be construed as being included in the invention.

No item or component is essential to the practice of the invention unless the element is specifically described as "essential" or "critical". It will also be recognized that the terms "comprises," "comprising," "includes," "including," "has," and "having," as used herein, are specifically intended to be read as open-ended terms of art. The use of the terms "a" and "an" and "the" and similar referents in the context of describing the invention (especially in the context of the following claims) are to be construed to cover both the singular and the plural, unless the context clearly indicates otherwise. In addition, it should be understood that although the terms "first," "second," etc. may be used herein to describe various elements, these elements should not be limited by these terms, which are only used to distinguish one element from another. Furthermore, recitation of ranges of values herein are merely intended to serve as a shorthand method of referring individually to each separate value falling within the range, unless otherwise indicated herein, and each separate value is incorporated into the specification as if it were individually recited herein.

We claim:

1. A trash compaction system comprising:

a trash receptacle through which trash is input;

a movable compaction chamber in which trash is compacted, the compaction chamber having a closeable receiving opening in communication with the trash receptacle to receive trash into the compaction chamber, the closeable receiving opening closeable by a movable cover positioned between the trash receptacle and the compaction chamber;

a plate against which the trash is compacted;

a compactor mechanism comprising a compactor actuator and a ram operatively coupled with the compaction chamber to compact trash between the plate and the ram, in a direction generally perpendicular to a direction in which the compaction chamber receives the trash; and the plate, the moveable compaction chamber, and the movable cover configured to form a closeable ejection opening openable by the compaction chamber and the movable cover when both of the compaction chamber and the movable cover slide away from the plate in a direction opposite to the direction in which the trash is compacted to eject the compacted trash from the compaction chamber.

2. The trash compaction system of claim 1, wherein the ejection opening is on an opposite side of the compaction chamber than the compactor mechanism such that the compactor mechanism compacts the trash in a direction toward the ejection opening.

3. The trash compaction system of claim 1, wherein the receiving opening is on an upper side of the compaction chamber below the trash receptacle.

4. The trash compaction system of claim 1, wherein the compaction chamber is generally horizontally-oriented and the direction in which the compaction chamber receives trash is generally vertically-oriented.

5. The trash compaction system of claim 1, wherein the compacted trash is ejected in a shape of a platter having a width substantially greater than a height thereof.

6. The trash compaction system of claim 1, wherein the trash is compacted into a disc having a width essentially equal to a width of the compaction chamber and a height substantially less than a width of the compaction chamber.

7. The trash compaction system of claim 1, further comprising a compacted trash collection bin disposed below the compaction chamber that receives and stores the ejected compacted trash.

8. The trash compaction system of claim 1, further comprising a user interface panel by which the trash compaction system may be locally controlled.

9. A trash compaction system comprising:

a trash receptacle through which trash is input;

a generally horizontally-oriented movable compaction chamber having a closeable generally vertically-oriented opening disposed to receive trash from above the compaction chamber via the trash receptacle, the generally vertically-oriented opening closeable by a movable cover positioned between the trash receptacle and the compaction chamber, the trash to be compacted within the compaction chamber;

a plate against which the trash is compacted;

a generally horizontally-oriented compactor mechanism comprising a compactor actuator and a ram operatively coupled with the compaction chamber to compact trash between the plate and the ram in a generally horizontally-oriented direction toward the plate; and the plate, the moveable compaction chamber, and the movable cover configured to form a closeable ejection opening openable by the compaction chamber and the movable cover when both of the compaction chamber and the movable cover slide away from the plate in a direction opposite to the direction in which the trash is compacted to eject the compacted trash from the compaction chamber.

10. The trash compaction system of claim 9, wherein the compacted trash is ejected in a shape of a platter having a width substantially greater than a height thereof.

11. The trash compaction system of claim 9, wherein the trash is compacted into a disc having a width essentially equal to a width of the compaction chamber and a height substantially less than a width of the compaction chamber.

12. The trash compaction system of claim 9, further comprising a compacted trash collection bin disposed below the compaction chamber that receives and stores the ejected compacted trash.

13. The trash compaction system of claim 9, further comprising a user interface panel by which the trash compaction system may be locally controlled.

14. A method for compacting trash comprising:

receiving trash in a movable compaction chamber through a closeable receiving opening via a trash receptacle;

closing the closeable receiving opening of the compaction chamber by sliding a movable cover positioned between the trash receptacle and the compaction chamber;

compacting the trash against a plate in a direction generally perpendicular to a direction in which the compaction chamber receives the trash;

opening a closeable ejection opening by sliding both the compaction chamber and the movable cover away from the plate in a direction opposite to the direction in which the trash is compacted; and ejecting the compacted trash from the compaction chamber through the closeable ejection opening.

15. The method of claim 14, wherein the compacted trash is ejected from the compaction chamber at an end of the compaction chamber toward which the trash is compacted.

16. The method of claim 14, wherein the trash is received into the compaction chamber in a generally vertically-oriented direction and compacted in a generally horizontally-oriented direction.

17. The method of claim 14, wherein the trash is compacted into a shape of a platter having a width substantially greater than a height thereof.

18. The method of claim 14, further comprising receiving and storing the compacted trash in a collection bin disposed below the compaction chamber.

19. The trash compaction system of claim 1, wherein the compactor mechanism compacts trash in a direction generally perpendicular to both a direction in which the compaction chamber receives the trash and a direction in which the compacted trash is ejected from the trash compaction system.

20. The trash compaction system of claim 9, wherein the compacted trash is ejected from the trash compaction system in a generally vertically-oriented direction.

* * * * *